US009163822B2

(12) United States Patent
Song et al.

(10) Patent No.: US 9,163,822 B2
(45) Date of Patent: Oct. 20, 2015

(54) LIGHT SOURCE ASSEMBLY

(71) Applicant: SAMSUNG ELECTRONICS CO., LTD., Suwon-si (KR)

(72) Inventors: Jin Kwan Song, Suwon-si (KR); Young Jeong Yoon, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 90 days.

(21) Appl. No.: 13/926,305

(22) Filed: Jun. 25, 2013

(65) Prior Publication Data

US 2014/0063805 A1 Mar. 6, 2014

(30) Foreign Application Priority Data

Aug. 30, 2012 (KR) ..... 10-2012-0095346

(51) Int. Cl.
*F21V 29/00* (2015.01)
*F21S 8/10* (2006.01)

(52) U.S. Cl.
CPC ..... *F21V 29/22* (2013.01); *F21S 48/115* (2013.01); *F21S 48/1109* (2013.01); *F21S 48/1154* (2013.01); *F21S 48/212* (2013.01); *F21S 48/215* (2013.01); *F21S 48/321* (2013.01); *F21S 48/328* (2013.01); *F21V 29/004* (2013.01)

(58) Field of Classification Search
CPC ..... H01L 33/62; F21Y 101/02; F21V 29/02; F21V 29/225; F21V 29/262; F21V 21/088; F21V 29/22; F21S 48/321
USPC ..... 174/252, 254; 362/249.02, 294, 373, 362/459–549, 655–656
See application file for complete search history.

(56) References Cited

U.S. PATENT DOCUMENTS

| | | | | |
|---|---|---|---|---|
| 6,299,337 | B1 * | 10/2001 | Bachl et al. | 362/545 |
| 8,118,462 | B2 | 2/2012 | Inoue et al. | |
| 8,262,256 | B2 * | 9/2012 | Biebl et al. | 362/249.02 |
| 8,619,211 | B2 * | 12/2013 | Bertram et al. | 349/61 |
| 2009/0103295 | A1 * | 4/2009 | Wang | 362/234 |
| 2009/0203254 | A1 * | 8/2009 | Weber et al. | 439/541 |
| 2010/0214799 | A1 * | 8/2010 | Ohmi et al. | 362/545 |
| 2011/0317420 | A1 * | 12/2011 | Jeon et al. | 362/249.02 |
| 2012/0044685 | A1 * | 2/2012 | Chen et al. | 362/249.02 |
| 2012/0120660 | A1 * | 5/2012 | Grauvogel | 362/249.02 |
| 2013/0265773 | A1 * | 10/2013 | Lin et al. | 362/311.01 |
| 2014/0126225 | A1 * | 5/2014 | Konishi et al. | 362/373 |

FOREIGN PATENT DOCUMENTS

| | | | |
|---|---|---|---|
| CN | 201661961 | U * | 12/2010 |
| JP | 2009-211966 | A | 9/2009 |
| KR | 20-0228983 | Y1 | 7/2001 |
| KR | 10-2007-0098354 | A | 10/2007 |
| KR | 10-2009-0065598 | A | 6/2009 |
| KR | 10-0910054 | B1 | 7/2009 |

OTHER PUBLICATIONS

Machine Translastion of CN 201661961U LIN.*

* cited by examiner

*Primary Examiner* — Jong-Suk (James) Lee
*Assistant Examiner* — Christopher E Dunay
(74) *Attorney, Agent, or Firm* — Sughrue Mion, PLLC

(57) ABSTRACT

Provided is a light source assembly including: a frame including a device region; a radiator mounted on the device region and detachable therefrom; and a light source including a light emitting device disposed at a position corresponding to the device region above the radiator.

20 Claims, 16 Drawing Sheets

LIGHT SOURCE ASSEMBLY

CROSS-REFERENCE TO RELATED APPLICATION

This application claims priority from Korean Patent Application No. 10-2012-0095346, filed on Aug. 30, 2012 in the Korean Intellectual Property Office, the disclosure of which is incorporated herein by reference in its entirety.

BACKGROUND

1. Field

Apparatuses consistent with exemplary embodiments relate to a light source assembly.

2. Description of the Related Art

Related art light emitting device modules having an electrical field and heat sink structure have been manufactured in various shapes and sizes corresponding to various automobile models. In order to manufacture a light emitting device module and a heat sink structure suitable for a corresponding automobile model, new molds are manufactured. As a result, there have been issues such as an increase in investment costs including molding costs, expenditures for jigs, and the like, and an increase in manufacturing costs, molding management expenditure consumption, and the like.

In particular, in the case of a light emitting device module using a high power light emitting device, a heat sink plane for heat emission or the like is additionally used, or an assembly in a portion at which an internal volume is relatively small is not easy. Therefore, as a scheme for solving such defects, standardization of at least one of a heat sink structure and a fixing method thereof has been demanded.

SUMMARY

One or more exemplary embodiments provide a light source assembly capable of being standardly used in automobiles, regardless of the model thereof, by standardizing a heat sink structure and being easily mounted.

According to an aspect of an exemplary embodiment, there is provided a light source assembly including: a frame including a device region; a radiator mounted on the device region and detachable therefrom; and a light source including a light emitting device on a position corresponding to the device region above the radiator.

The light source assembly may include a plurality of device regions, including the device region, at different height levels.

The frame may include a first frame portion including the device region, and a second frame portion extended in a direction perpendicular to the first frame portion, and the first frame portion and the second frame portion may be alternately connected to each other in an extended step structure.

The first frame portion may include a mounting surface on which the radiator is mounted, and a side wall forming a space defining the device region together with the mounting surface, and the mounting surface may include a radiation hole formed in a central portion of the mounting surface, allowing air to flow therethrough.

The radiator may include a base member on which the light emitting device is disposed and supported thereby, and support members extended from two edges of the base member in a direction perpendicular to a direction of the base member, and mounted on the device region.

The radiator may further include auxiliary support members extended from two remaining edges of the base member in the direction perpendicular to the direction of the base member.

The radiator may further include a radiating rod on a lower surface of the base member to increase a radiation area.

The frame may further include guide members in the device region, and the support members may be insertedly fixed to the device region by the guide members in the device region when the support members are mounted on the device region.

The base member may include at least one alignment hole guiding a disposition of the light emitting device.

The light source may further include a substrate between the radiator and the light emitting device and having the light emitting device mounted thereon, and the substrate may be extended such that a plurality of radiating units are integratedly connected to one another.

According to an aspect of another exemplary embodiment, there is provided a light source assembly including: a frame including a device region; a radiator including a base member and support members extended and bent from two edges of the base member, and mounted on the device region such that the radiator is detachable from the device region through the support members; a light source including a light emitting device on a position corresponding to the device region above the base member; and fixers selectively fastened to the support members to allow the support members to be mounted on the device region so as to be detachable from the device region.

The fixers may be elastically provided on a side of the frame contacting the support members on the device region and may include protrusion members protruded toward the device region.

The support members may include fastening holes into which the protrusion members are inserted when the support members are mounted on the device region.

The frame may include a first frame portion including the device region, and a second frame portion extended in a direction perpendicular to the first frame portion, and the first frame portion and the second frame portion may be alternately connected to each other in an extended step structure.

The light source may further include a substrate disposed between the radiator and the light emitting device and having the light emitting device mounted thereon, and the substrate may be extended such that a plurality of radiators are integratedly connected to one another.

According to an aspect of another exemplary embodiment, there is provided a light source assembly including: a frame including a device region; and a radiator mounted on the device region and detachable therefrom, the radiator including a base member for mounting a light emitting device, and the radiator discharging heat from the light emitting device into a space between the device region and the radiator.

BRIEF DESCRIPTION OF THE DRAWINGS

The above and/or other aspects will be more clearly understood from the following detailed description taken in conjunction with the accompanying drawings, in which.

DETAILED DESCRIPTION OF EXEMPLARY EMBODIMENTS

Figure 1:
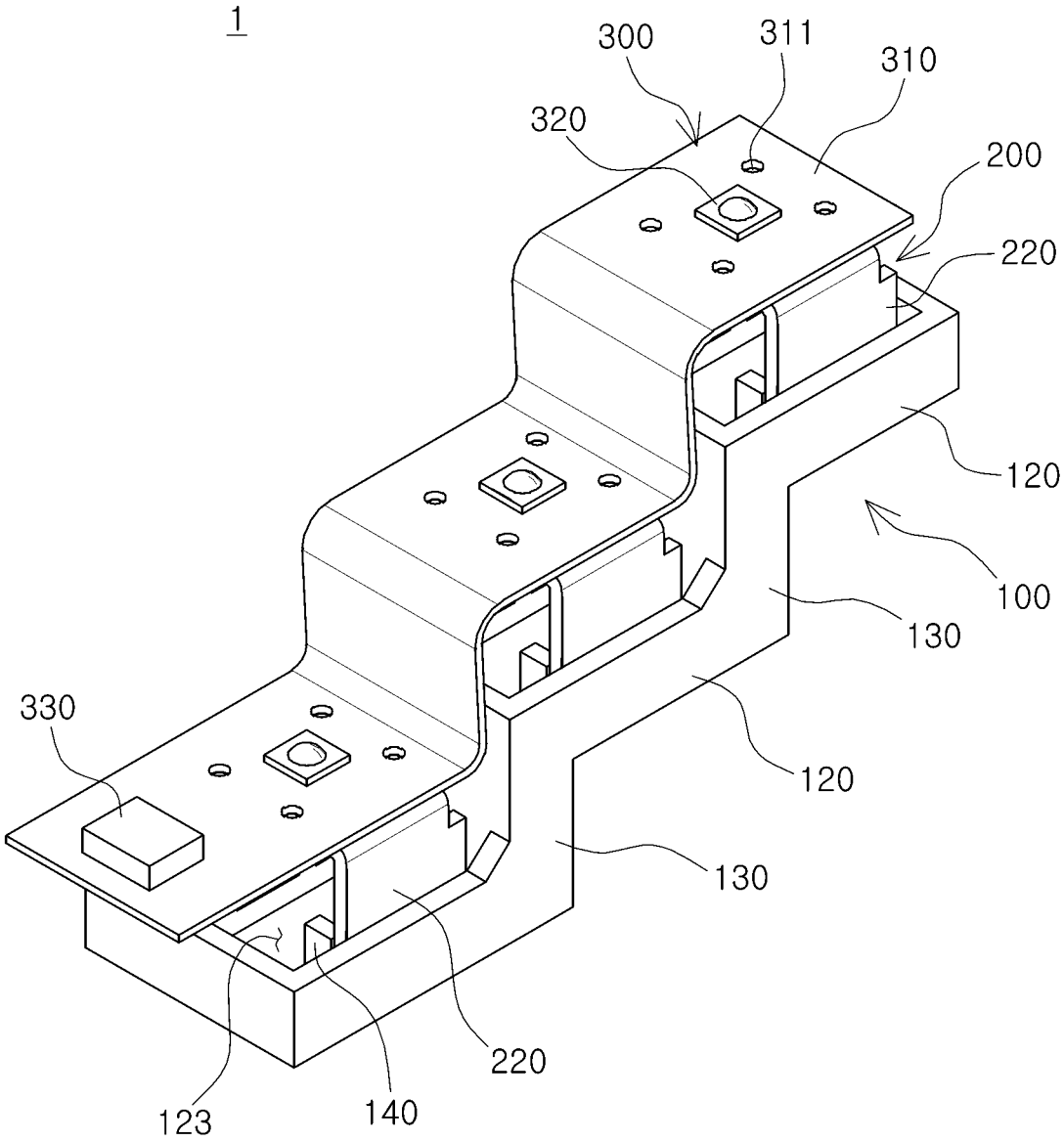
FIG. 1 is a schematic perspective view of a light source assembly according to an exemplary embodiment.

Hereinafter, exemplary embodiments will be described in detail with reference to the accompanying drawings. The inventive concept may, however, be embodied in many different forms and should not be construed as being limited to exemplary embodiments set forth herein. Rather, these exemplary embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements. Furthermore, it is understood that expressions such as "at least one of," when preceding a list of elements, modify the entire list of elements and do not modify the individual elements of the list.

Referring to FIGS. 1 to 7B, a light source assembly 1 according to an exemplary embodiment may include a frame 100, a radiator 200, and a light source 300.

The frame 100 may include at least one device region 110 and may be formed through injection molding of an insulating resin or the like. The frame 100 may be installed in an illumination device such as a head light, a rear light, or a brake light of an automobile, or the like.

Figure 2:
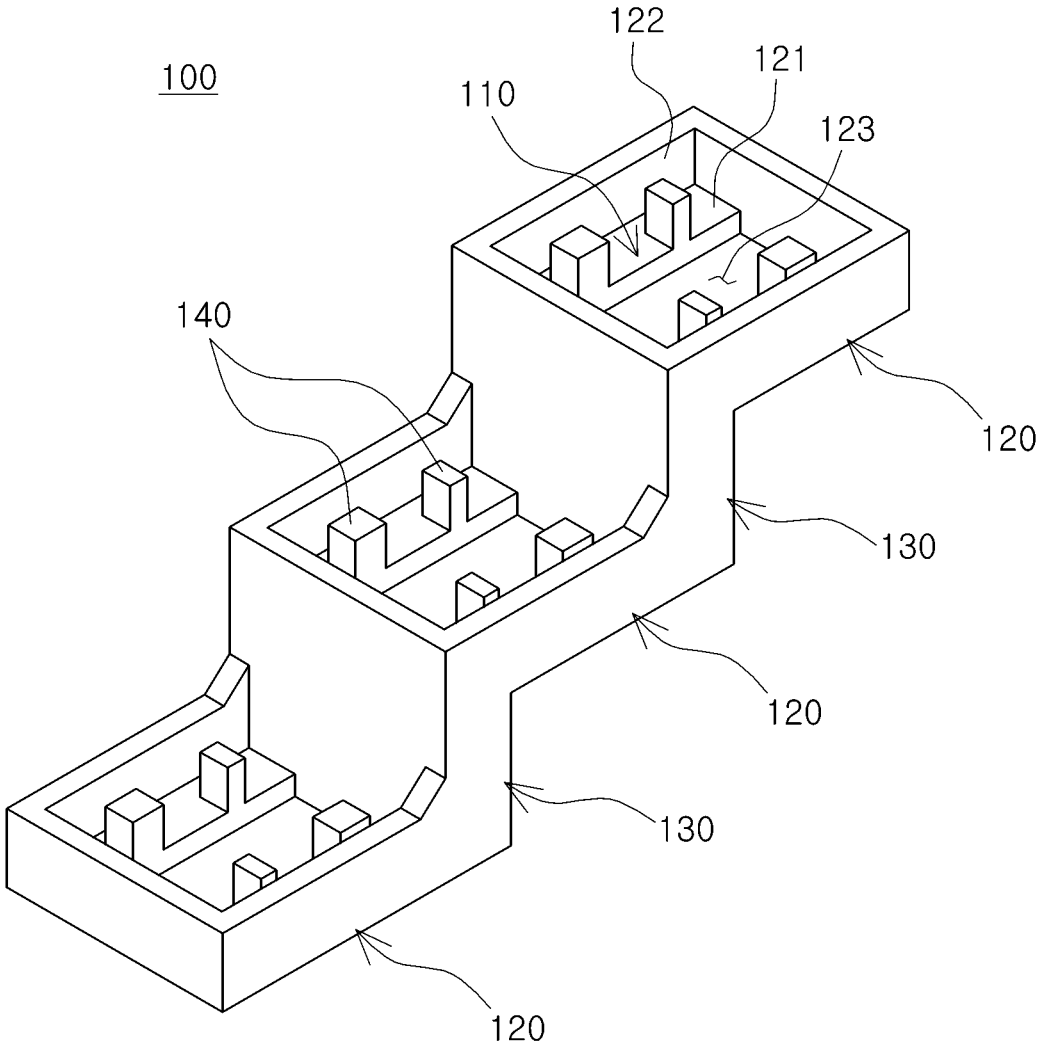
FIG. 2 is a schematic perspective view of a frame of the light source assembly of FIG. 1.
Figure 3:
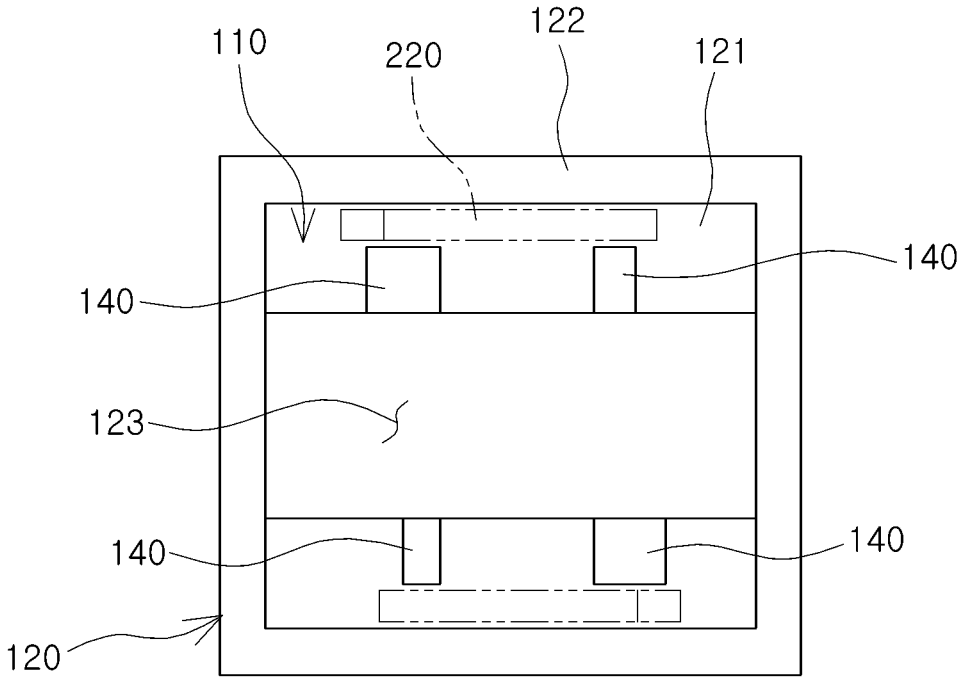
FIG. 3 is a plan view schematically showing a device region in the frame of FIG. 2.

FIGS. 2 and 3 schematically illustrate a frame 100 and device regions 110 according to an exemplary embodiment. As shown in FIGS. 2 and 3, the frame 100 may include a first frame portion 120 in which the radiator 200 to be described below is mounted, and a second frame portion 130 extended in a direction perpendicular to the first frame portion 120. The first and second frame portions 120 and 130 may be alternately connected to each other to have an extended step structure. Therefore, the device region 110 may be provided in plural and positioned on different levels. That is, the plurality of device regions 110 may be disposed at different heights.

The present exemplary embodiment illustrates a case in which three device regions 110 are included, although it is understood that one or more other exemplary embodiments are not limited thereto. For example, the number of the device regions 110 may vary and be greater than, less than, or equal to three depending, for example, upon an automobile model.

The first frame portion 120 may include a mounting surface 121 on which the radiator 200 is mounted, and a side wall 122 forming a space having a predetermined size defining the device region 110 together with the mounting surface 121.

The second frame portion 130 may have a structure in which one end thereof is extended from the side wall 122 and the other end thereof configures a portion of a side wall 122 of a different first frame portion 120 so as to integrally connect the first frame portion 120 to the second frame portion 130.

The present exemplary embodiment provides a mounting surface 121 that has a quadrangular shape and a side wall 122 that forms four sides, although it is understood that one or more other exemplary embodiments are not limited thereto. For example, the device region 110 defined by the mounting surface 121 and the side wall 122 may vary and have various shapes.

The mounting surface 121 may be provided with a radiation hole 123 in the center thereof allowing air and, for example, heat to flow therethrough. That is, the device region 110 may have an open structure in which a bottom surface thereof is open through the radiation hole 123.

The mounting surface 121 may be provided with guide members 140 respectively on both sides thereof having the radiation hole 123 therebetween. The guide members 140 may guide mounting of the radiator 200 to be described below and also serve to fix the mounted radiator 200.

Figure 4A:
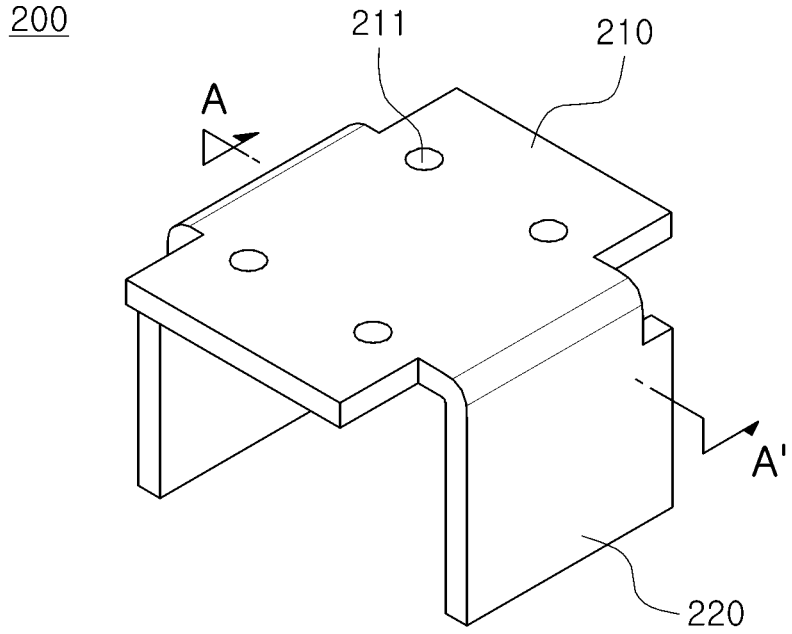
FIG. 4A is a schematic perspective view of a radiator in the light source assembly of FIG. 1.
Figure 4B:
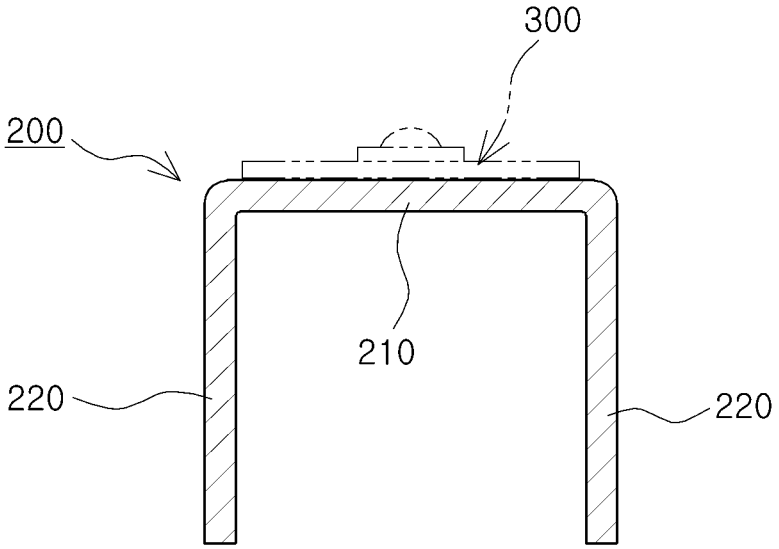
FIG. 4B is a cross-sectional view of the radiator of FIG. 4A taken along axis A-A' of FIG. 4A.

FIGS. 4A and 4B illustrate a radiator 200 according to an exemplary embodiment. FIG. 4A is a perspective view schematically illustrating the radiator 200 in the light source assembly 1 of FIG. 1 and FIG. 4B is a cross-sectional view taken along axis A-A' of a radiator 200 of FIG. 4A.

The radiator 200 is, for example, a heat sink mounted to be detachable from the plurality of respective device regions 110, and may be provided with the light source 300 mounted thereon, to be described below, while supporting the light source 300. In addition, the radiator 200 may discharge heat generated from the light source 300 to the outside thereof.

As shown in FIGS. 4A and 4B, the radiator 200 may include a base member 210 on which the light source 300 is located, and a support member 220 extended from an edge of the base member 210 and bent in a direction perpendicular to that of the light source 300, based on the base member 210, and mounted on the device region 110. The base member 210 and the support member 220 may be integrated by press processing a single metal plate.

The base member 210 may include an alignment hole 211 guiding disposition of the light source 300 when the light source 300 is disposed on the base member 210. The support member 220 may be provided as a pair of support members opposing each other to be aligned.

Although the present exemplary embodiment describes a case in which the base member 210 has a quadrangularly shaped plate structure and the support members 220 are extended from two opposing edges of the base member 210 to be a pair, it is understood that one or more other exemplary embodiments are not limited thereto. For example, the base member 210 may be formed to have a polygonal shape, and the support members 220 may be configured as a plurality of pairs, as a pair of adjacent support members, or may vary in other exemplary embodiments.

The support members 220 may be insertedly fixed to the device region 110 by the guide members 140 provided with the device region 110 when the support members 220 are mounted on the device region 110. That is, the radiator 200 may be easily mounted in the frame 100 through a simplified insertion fixing scheme.

Figure 5A:
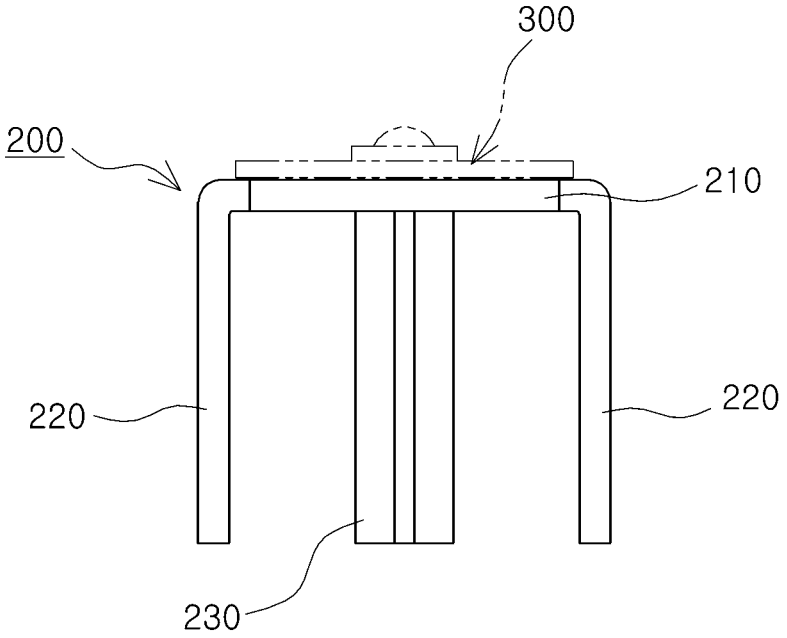
FIG. 5A is a cross-sectional view schematically showing an example of a radiator according to another exemplary embodiment.
Figure 5B:
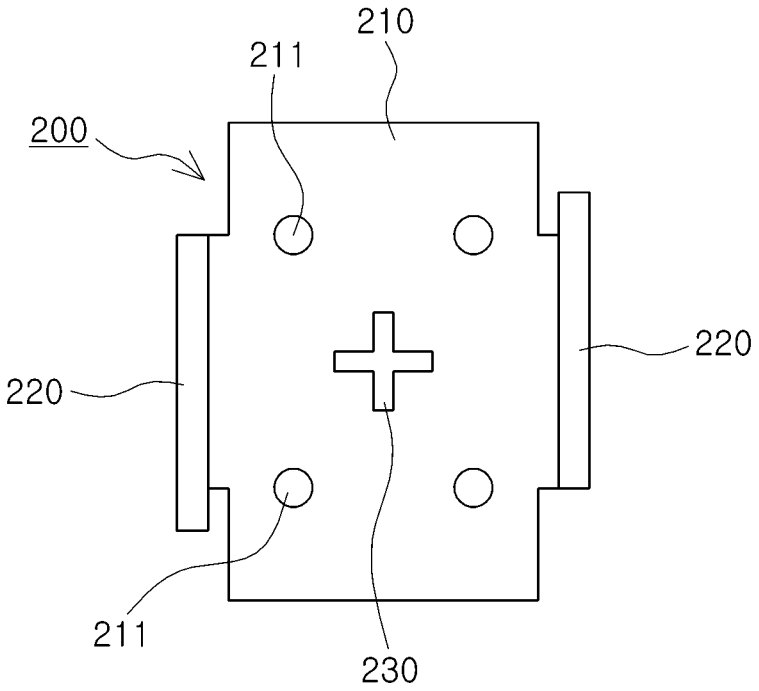
FIG. 5B is a bottom view of FIG. 5A.

FIGS. 5A and 5B illustrate an example of a radiator 200 according to another exemplary embodiment. FIG. 5A is a cross-sectional view illustrating a variation of the radiator 200 of FIG. 4 and FIG. 5B is a bottom view of FIG. 5A.

As shown in FIGS. 5A and 5B, the radiator 200 may further include a radiating rod 230 provided on a lower surface of the base member 210 to increase a radiation area. In the radiating rod 230, at least one portion may be extended from a lower surface of the base member 210 to be aligned with the support member 220. The radiating rod 230 may have a cross (+) shaped cross-section to provide a relatively large radiation area.

Figure 6A:
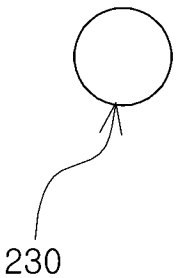
FIGS. 6A to 6D are cross-sectional views schematically illustrating various examples of the radiating rod of FIGS. 5A and 5B.
Figure 6B:
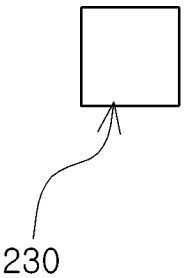
Figure 6C:
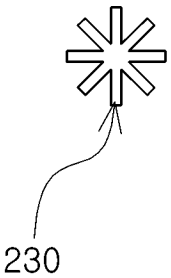
Figure 6D:
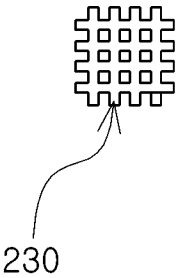

However, it is understood that the shape of the radiating rod 230 is not limited thereto in one or more other exemplary embodiments. FIGS. 6A to 6D schematically illustrate various shapes of the radiating rod 230 according to exemplary embodiments. In detail, the radiating rod 230 may have a star shaped cross-section or a lattice form as illustrated in FIGS. 6C and 6D, respectively, as well as a simple structure such as a circular or a quadrangular cross-section, as illustrated in FIGS. 6A and 6B, respectively.

Figure 7A:
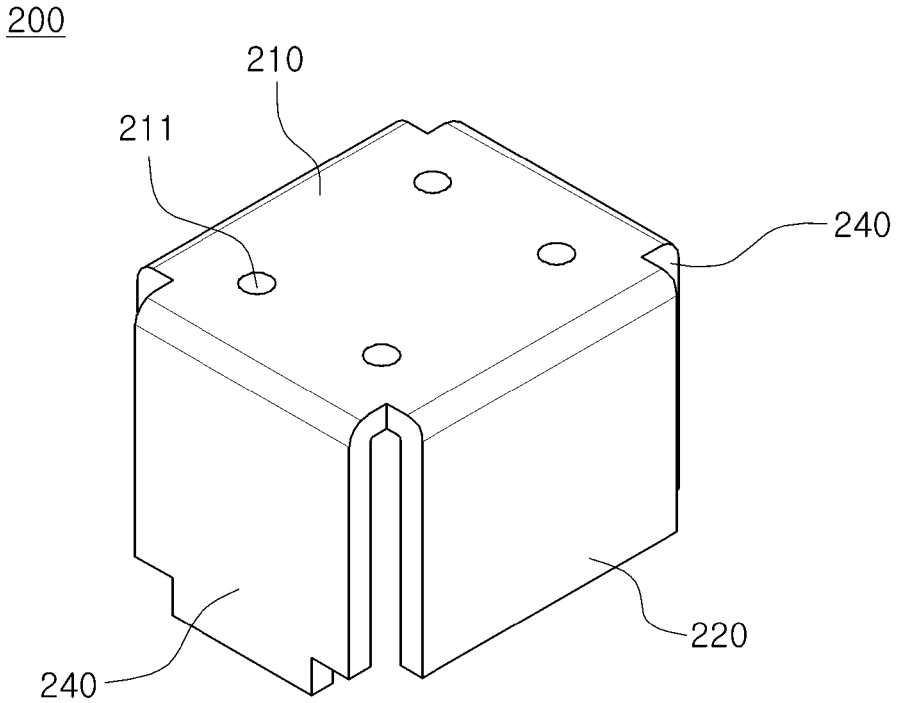
FIG. 7A is a schematic perspective view of the radiator of FIG. 4 according to another exemplary embodiment.
Figure 7B:
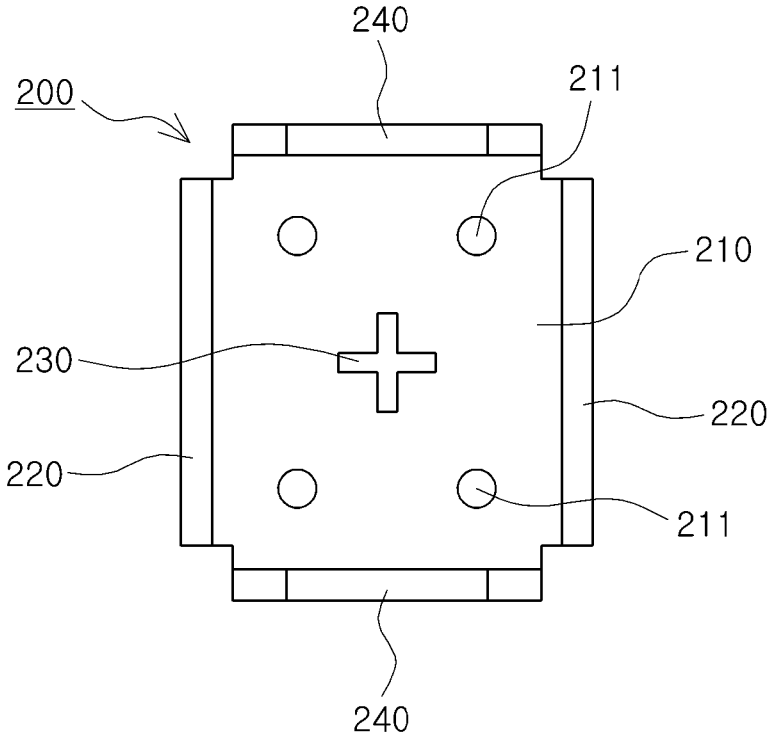
FIG. 7B is a bottom view of FIG. 7A.

FIGS. 7A and 7B illustrate the radiator 200 according to another exemplary embodiment. The radiator 200 according to the present exemplary embodiment may include a base member 210, support members 220 extended from two edges of the base member 210, and auxiliary support members 240 extended like the support members 220 from the two remaining edges of the base member 210 such that the auxiliary support members 240 are perpendicular to the support members.

In detail, as shown in FIGS. 7A and 7B, in a case in which the base member 210 has a quadrangular shape, the support members 220 may be extended from two opposing edges of the base member 210, and the auxiliary support members 240 may be extended from the two remaining edges thereof in a direction perpendicular to the two opposing edges. In this case, mutually adjacent edges of the support members 220 and the auxiliary support members 240 in a height direction of the radiator 200 do not contact each other. Therefore, air may flow through a gap between the edges which are adjacent to each other but are not in contact.

As such, in the radiator 200 according to the present exemplary embodiment, the base member 210 provided with the light source 300 mounted thereon may be disposed to be spaced apart from the frame 100 through one pair of support members 220 such that the base member 210 is disposed above the frame 100, and air may flow through gaps between the support members 220 such that an air radiating effect achieved through natural convection may be improved.

In addition, a bottom of the device region 110 of the frame 100 to which the radiator 200 is fixed may not be blocked but be open through the radiation hole 123. Thus, a flow of air may be maintained through the radiation hole 123 while the flow thereof is maintained through the gap between the support members 220, thereby significantly increasing radiation efficiency.

The radiator 200 may be formed of (e.g., include) a metal having excellent heat conductivity in order to improve radiation efficiency. For example, the radiator 200 may include an AL10-series pressed aluminum alloy containing AL1050 or the like, an ALDC12-series die cast aluminum alloy, an AZ91D-series die cast magnesium alloy, or the like.

In addition, mass production thereof may be obtained using a progressive, a semi-progressive, or a die-casting form of a mold. The plurality of radiators 200 mass produced as described above may be individually mounted on the device regions 110 of the frame 100 through a simple insertion fixation scheme such that a heat sink structure for mounting of the light source 300 may be completed. In addition, the plurality of radiators 200 mounted in the frame 100 may be provided to have an overall stepped structure so as to correspond to a structure of the frame 100.

The radiator 200 mounted in the frame 100 may be standardly used in automobiles, regardless of the model thereof, and a heat sink structure capable of satisfying design conditions of respective models may be easily manufactured by adjusting the number of the radiators 200 mounted in the frame. For example, depending on the automobile model in which they are included, automobile daytime running lights (DRL) have various design structures. In a related art, a heat sink structure has been separately manufactured according to the model thereof, and therefore, there has been a need to separately manufacture a mold for each automobile model.

According to an exemplary embodiment, a heat sink structure may be easily manufactured in a scheme in which a standardly used radiator 200 is further mounted or the number of the standardly used radiators 200 mounted therein is reduced, according to a design. Accordingly, there is no need to separately manufacture the heat sink structure formed to be integrated per automobile model as in the related art and there is no need to separately manufacture a mold per automobile model thereby, whereby investment costs and manufacturing costs may be reduced.

The light source 300 may include a substrate 310 mounted on the plurality of radiators 200, and a plurality of light emitting devices 320 mounted on the substrate 310 such that the plurality of light emitting devices 320 are respectively disposed on positions thereof corresponding to the device regions 110 on the radiators 200. The substrate 310 may include a connector 330 provided on one edge portion thereof to be connected to an external power source.

The substrate 310 may be integratedly formed (e.g., provided) to be fixed to upper parts of the respective base members 210 of the plurality of radiators 200 and may be extended to integratedly connect the plurality of radiators 200 to one another. The substrate 310 may have a step structure to correspond to the step structure of the frame 100 and the plurality of radiators 200 mounted therein at the time of the mounting thereof. Therefore, the substrate 310 may include a flexible printed circuit board (FPCB) capable of being readily bent to correspond to different positions of the base members 210 according to the step structure.

The substrate 310 may be adhered to an upper part of the base member 210 through an adhesive or the like. The substrate 310 may have fiducial marks 311 to corresponding to alignment holes 211 of the base member 210. The fiducial marks 311 may facilitate mounting of the substrate 310 on an appropriate position corresponding thereto.

The light emitting device 320 may be a semiconductor device generating light having a predetermined wavelength when external power is applied thereto, and may include a light emitting diode (LED). The light emitting device may emit blue light, green light, or red light depending upon a material contained therein, and may also generate white light.

The plurality of light emitting devices 320 may be variously configured of the same type devices generating light having the same wavelength or different type devices generating light having different wavelengths. In addition, the plurality of light emitting devices 320 may be variously configured according to power levels thereof, for example, for about 0.5 W or 1 W. The light emitting device 320, for example, a product such as LA H9GP, LUW H9GP, LUW CN7N, or the like, by OSRAM may be used. In addition, the light emitting device 320, for example, a product such as LXMA-PL02, LXMA-PH01, LXMA-PW01, or the like, by PHILIPS, may be used. Various other products may be compatible or may additionally be used according to the extent of power.

The light emitting device 320 may be an LED chip or a single package including an LED chip therein.

Various exemplary embodiments of a light emitting device 320 will now be described with reference to FIGS. 8 to 11.

Figure 8:
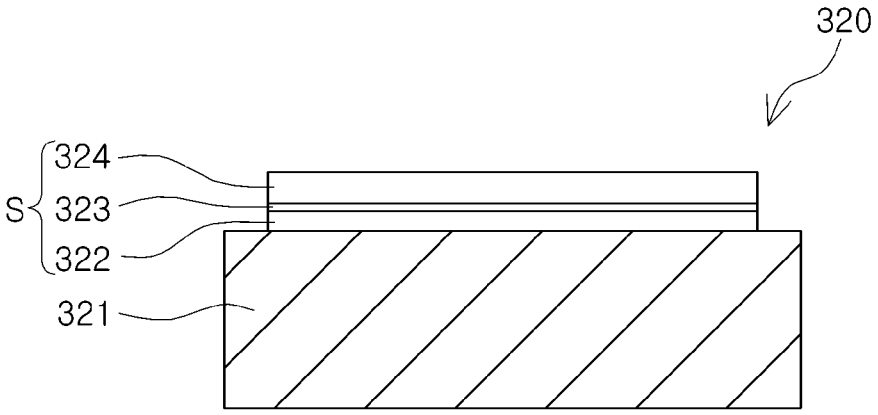
FIGS. 8 to 11 are schematic cross-sectional views illustrating various exemplary embodiments of a light emitting device.
Figure 9:
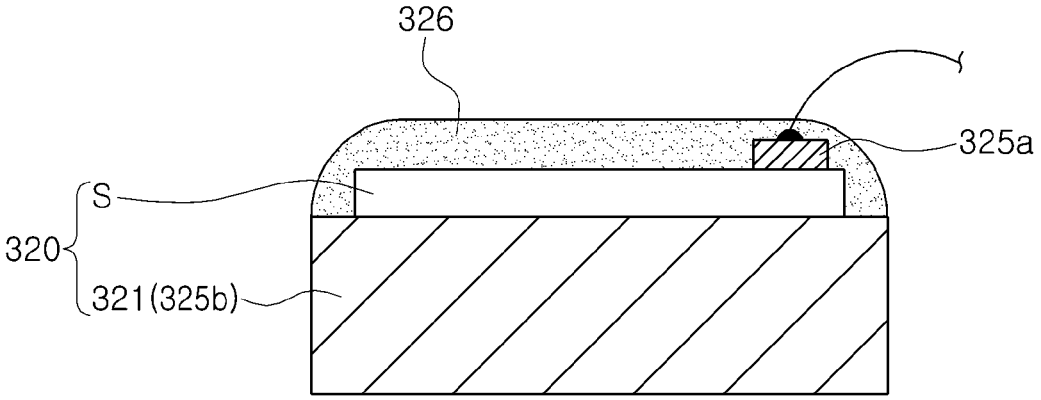

As shown in FIGS. 8 and 9, the LED chip 320 as a light emitting device according to an exemplary embodiment may have a structure in which a light emitting structure S is disposed on a conductive substrate 321, and the light emitting structure S may have a structure in which a p-type semiconductor layer 322, an active layer 323, and an n-type semiconductor layer 324 are disposed in sequence. The n-type and p-type semiconductor layers may be represented by an empirical formula $Al_xIn_yGa_{(1-x-y)}N$ (here, satisfying the conditions of $0 \le x \le 1$, $0 \le y \le 1$, $0 \le x+y \le 1$), and for example, a material such as GaN, AlGaN, InGaN, AlInGaN, or the like may be used. The active layer 323 between the n-type and p-type semiconductor layers 324 and 322 may emit light having a predetermined degree of energy through the recombination of electrons and holes. Further, the active layer 323 may have a multiple quantum well (MQW) structure, for example, an InGaN/GaN structure, in which quantum well layers and quantum barrier layers are alternately stacked on top of each other.

An N-type electrode 325*a* may be formed (e.g., provided) on one surface of the n-type semiconductor layer 324. The conductive substrate 321 may serve as a p-type electrode 325*b* while supporting the light emitting structure S, and may be formed of (e.g., include) a material including any of Au, Ni, Al, Cu, W, Si, Se and GaAs. The LED chip 320 itself may have a structure corresponding to a vertical structure.

Figure 10:
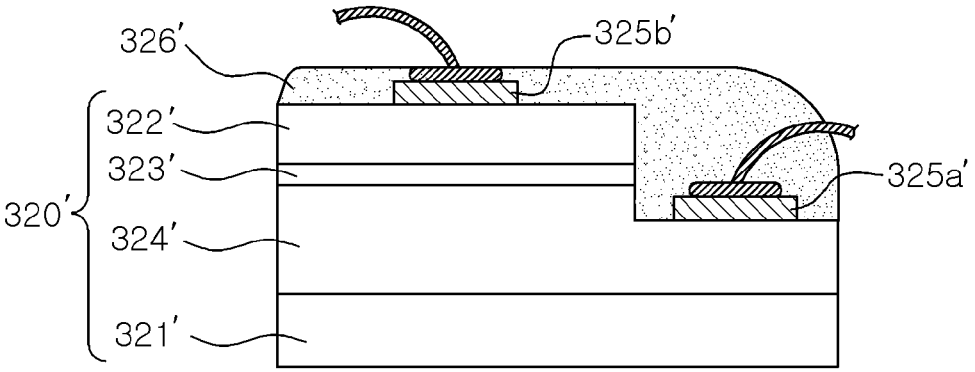

FIG. 10 illustrates an LED chip 320' according to another exemplary embodiment. The LED chip 320' may include a substrate 321', an n-type semiconductor layer 324', an active layer 323' and a p-type semiconductor layer 322'. An exposed surface of the n-type semiconductor layer 324' and a surface of the p-type semiconductor layer 322' may respectively have n-type and p-type electrodes 325*a'* and 325*b'* formed thereon, and the LED chip 320' itself may have a structure corresponding to a horizontal structure.

As shown in FIGS. 9 and 10, in the case in which the light emitting device is an LED chip 320 and 320', a light emitting surface from which light is emitted, for example, an upper surface or an upper surface and a side thereof may have a wavelength conversion unit 326 or 326' (e.g., wavelength converter) formed thereon. The wavelength conversion units 326 and 326' may convert a wavelength of light emitted from the light emitting device, that is, the LED chip 320 or 320'. To this end, a structure in which a phosphor is distributed in a transparent resin may be employed, or a scheme in which phosphors are sintered to have a plate shape or the like and the sintered phosphors having the plate shape or the like, are bonded to the LED chip surface, may also be used.

Light converted by the wavelength conversion unit 326 and 326' and light emitted from the LED chip 320 and 320' are mixed, such that the light emitting device may emit white light. For example, in a case in which the LED chip 320 and 320' emits blue light, a yellow phosphor or a green phosphor may be used. In a case in which the LED chip 320 and 320' emits ultraviolet light, a mixture of red, green, and blue phosphors may be used.

More specifically, in the case in which blue light is emitted from the LED chip 320, a red phosphor may be a nitride-based MAlSiNx:Re($1 \le x \le 5$) phosphor, a sulfide-based MD:Re phosphor, or the like. Here, M may be at least one element selected from among barium (Ba), strontium (Sr), calcium (Ca), and magnesium (Mg), D may be at least one element selected from among sulfur (S), selenium (Se), and tellurium (Te), and Re may be at least one element selected from among europium (Eu), yttrium (Y), lanthanum (La), cerium (Ce), neodymium (Nd), promethium (Pm), samarium (Sm), gadolinium (Gd), terbium (Tb), dysprosium (Dy), holmium (Ho), erbium (Er), thulium (Tm), ytterbium (Yb), lutetium (Lu), fluorine (F), chlorine (Cl), bromine (Br), and iodine (I). In addition, a green phosphor may be a silicate-based $M_2SiO_4$:Re phosphor, a sulfide-based $MA_2D_4$:Re phosphor, a β-SiAlON:Re phosphor, an oxide-based $MA'_2O_4$:Re' phosphor, or the like. Here, M may be at least one element selected from among barium (Ba), strontium (Sr), calcium (Ca) and magnesium (Mg), A may be at least one element selected from among gallium (Ga), aluminum (Al) and indium (In), D may be at least one element selected from among sulfur (S), selenium (Se) and tellurium (Te), A' may be at least one element selected from among scandium (Sc), yttrium (Y), gadolinium (Gd), lanthanum (La), lutetium (Lu), aluminum (Al) and indium (In), Re may be at least element one selected from among europium (Eu), yttrium (Y), lanthanum (La), cerium (Ce), neodymium (Nd), promethium (Pm), samarium (Sm), gadolinium (Gd), terbium (Tb), dysprosium (Dy), holmium (Ho), erbium (Er), thulium (Tm), ytterbium (Yb), lutetium (Lu), fluorine (F), chlorine (Cl), bromine (Br), and iodine (I), and Re' may be at least one element selected from among cerium (Ce), neodymium (Nd), promethium (Pm), samarium (Sm), terbium (Tb), dysprosium (Dy), holmium (Ho), erbium (Er), thulium (Tm), ytterbium (Yb), fluorine (F), chlorine (Cl), bromine (Br) and iodine (I).

Meanwhile, in substitution for the phosphor or together with the phosphor, quantum dots may be included in the wavelength conversion unit 326 and 326'. The quantum dots are nano crystal particles formed of cores and shells. Here, the core size may range from approximately 2 to 100 nm. Further, the quantum dots may be used as a phosphor material emitting light having various colors such as blue (B), yellow Y, green (G) and red (R) by adjusting the size of a core. In addition, the quantum dots may have a core and shell structure in which at least two-type semiconductors of a group II-VI-based compound semiconductor (ZnS, ZnSe, ZnTe, CdS, CdSe, CdTe, HgS, HgSe, HgTe, MgTe, or the like), a group III-V-based compound semiconductor (GaN, GaP, GaAs, GaSb, InN, InP, InAs, InSb, AlAs, AlP, AlSb, AlS or the like), and a group IV-based semiconductor (Ge, Si, Pb, or the like) are heterobonded.

In addition, in order to emit white light, an LED chip 320 and 320' and phosphors having various colors may be variously combined. Even in the case that an LED chip 320 and 320' does not emit white light, a light source emitting red, amber color, or similar-colored light may also be implemented, although it is understood that one or more other exemplary embodiments are not limited thereto, and an LED chip 320 and 320' or a combination of an LED chip 320 and 320' and at least one of phosphors and quantum dots may be provided to output any color of light.

For example, amber light may be emitted using an α-sialon phosphor, a silicate orange phosphor, or the like. Here, the α-sialon may be a yellowish-orange phosphor represented by an empirical formula of (Sr, Ba, Ca)$Si_{12-(m+n)}Al_{(m+n)}O_n N_{16-n}$. In addition, as an active agent, a rare-earth element (Re) may be further included therein. The rare-earth element may be selected from Ce, Pr, Nd, Sm, Eu, Gd, Tb, Dy, Ho, Er, Tm, Yb, and the like.

Figure 11:
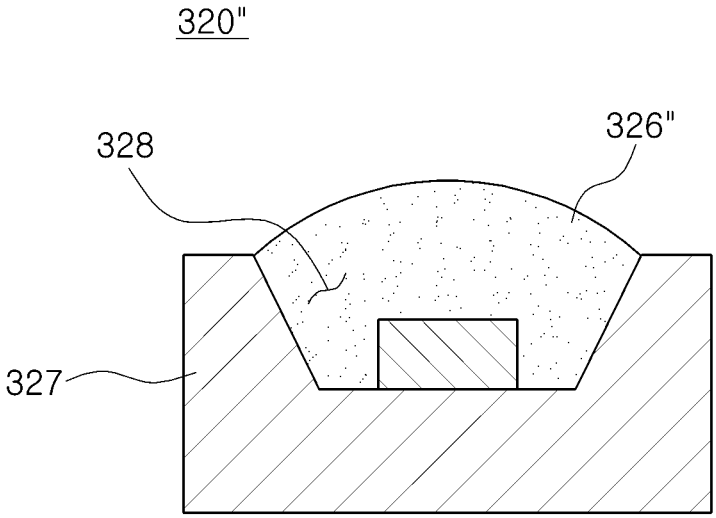
Figure 12:
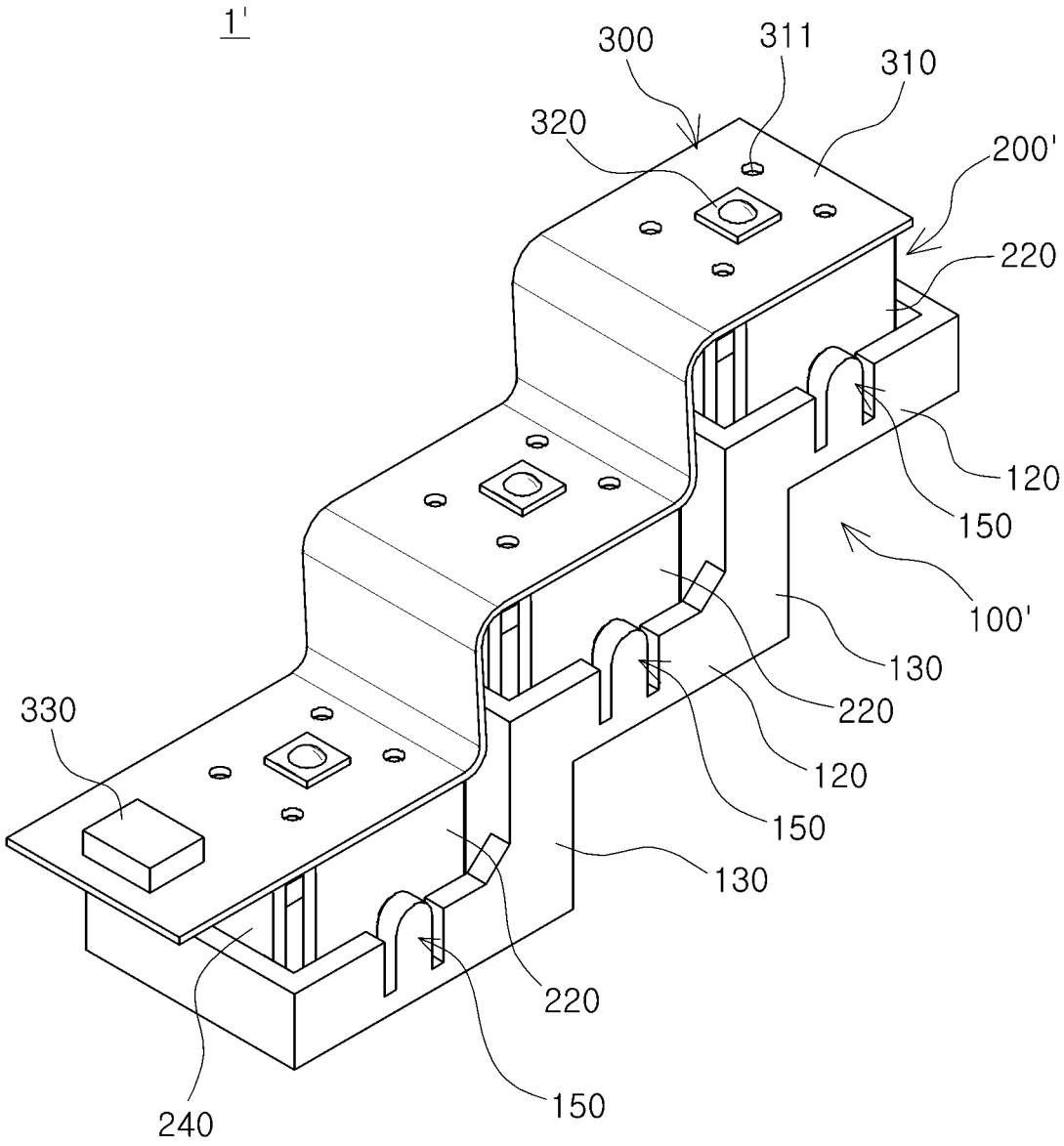
FIG. 12 is a schematic perspective view of a light source assembly according to another exemplary embodiment.
Figure 13:
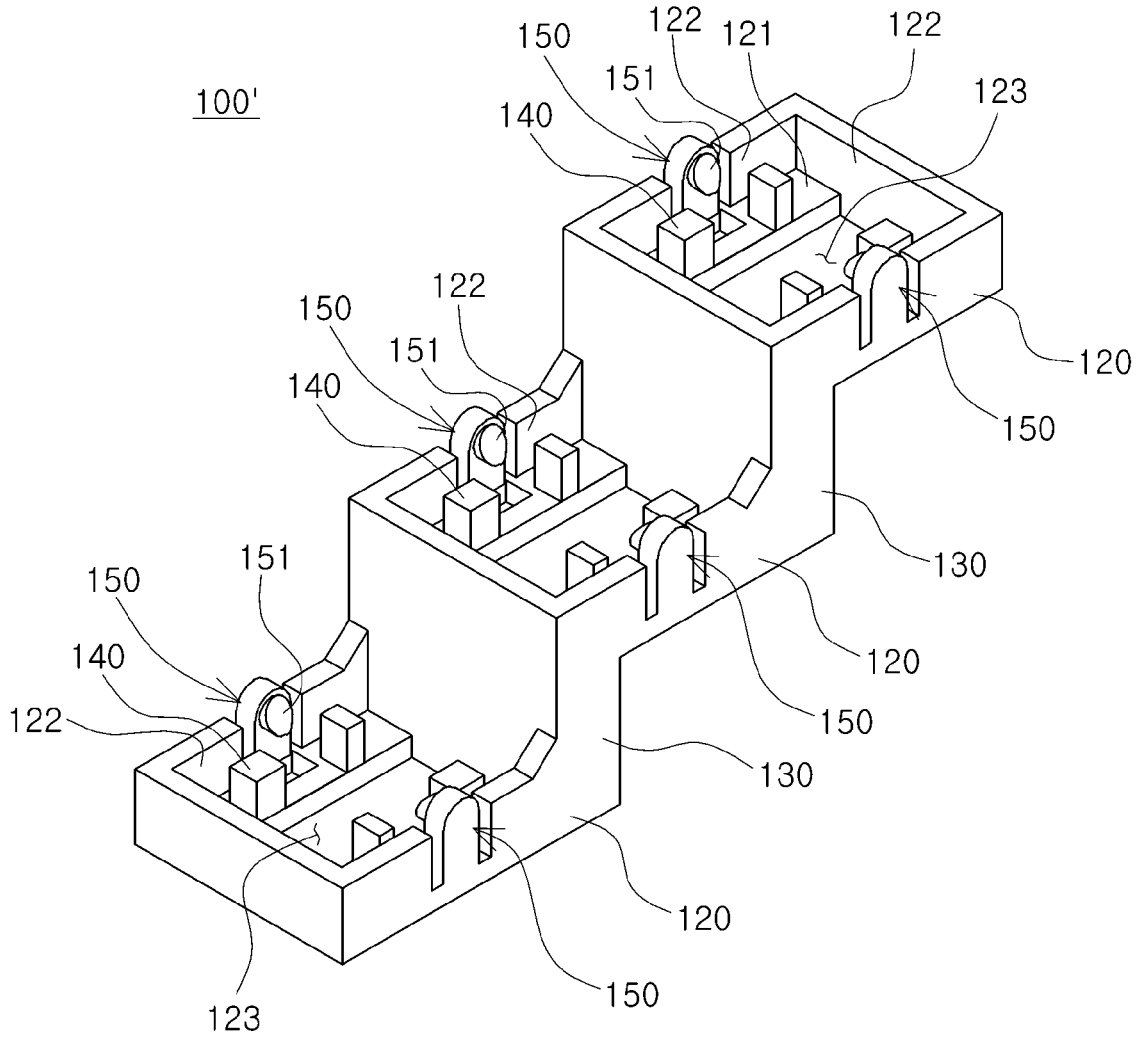
FIG. 13 is a schematic perspective view of a frame of the light source assembly of FIG. 12.
Figure 14:
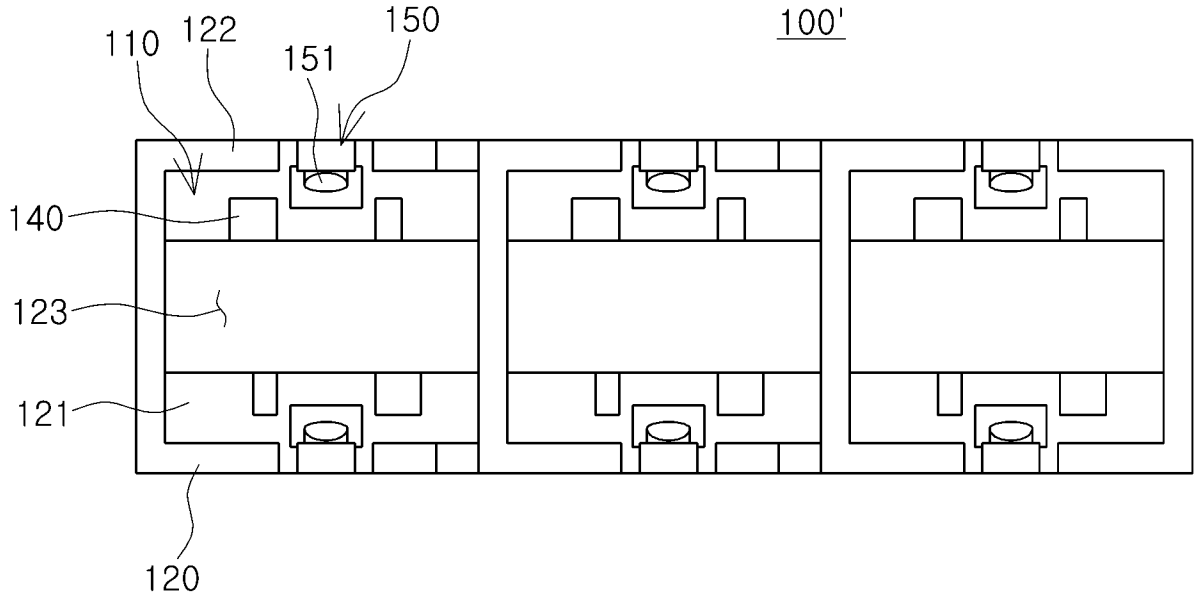
FIG. 14 is a plan view schematically showing a device region in the frame of FIG. 13.
Figure 15A:
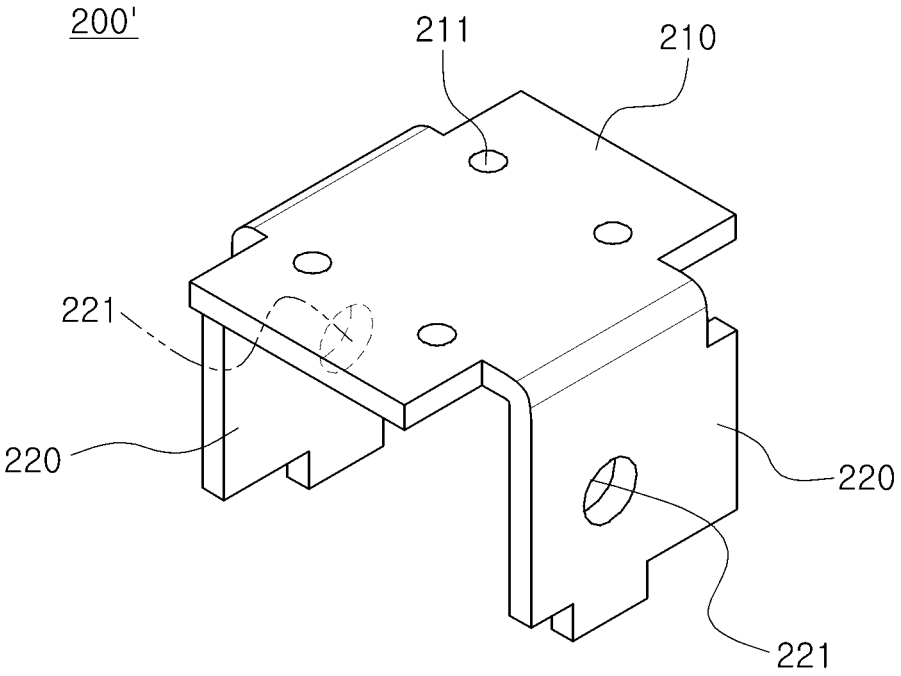
FIGS. 15A and 15B are schematic perspective views of a radiator in the light source assembly of FIG. 12.
Figure 15B:
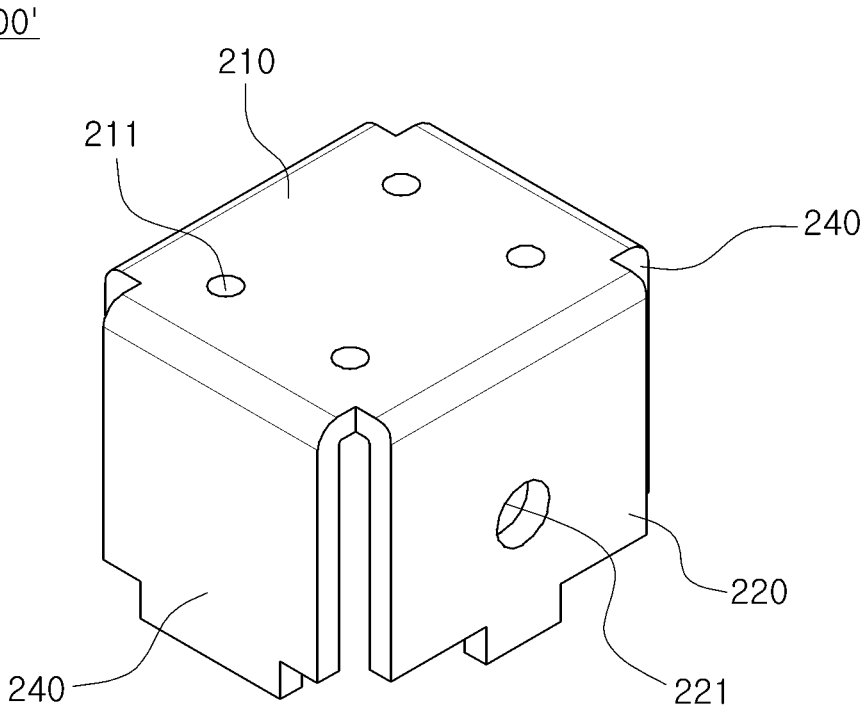

Meanwhile, as shown in FIG. 11, in a case in which a light emitting device 320" is a single package including an LED chip therein, the LED chip may be mounted within a reflecting cup 327 included in a package body, and a wavelength conversion unit 326" (e.g., wavelength converter) may have a structure in which the wavelength conversion unit 326" fills the reflecting cup 327 so as to encapsulate the LED chip.

The wavelength conversion unit 326" may further include fine, transparent particles 328. The fine, transparent particles may be mixed with a phosphor and a resin and may be a material such as $SiO_2$, $TiO_2$, $Al_2O_3$, or the like. A color temperature of light emitted outwardly may be set to a required or a desired color temperature level by appropriately controlling a ratio of a transparent fine particle and a phosphor included in the wavelength conversion unit 326".

The plurality of light emitting devices 320 may be mounted to have a step structure to correspond to a disposition structure of the device regions 110 and the respective radiators 200 mounted thereon.

FIGS. 12 to 14, 15A and 15B, and 16A to 16C illustrate a light source assembly 1' according to another exemplary embodiment.

A basic structure of components configuring a light source assembly 1' according to an exemplary embodiment illustrated in FIGS. 12 to 14, 15A and 15B, and 16A to 16C is substantially the same as or similar to that of the light source assembly 1 according to the exemplary embodiment illustrated in FIGS. 1 to 3, 4A and 4B, 5A and 5B, 6A to 6D, and 7A and 7B, except for a structure in which a fixer 150 is provided with a frame 100' such that the radiator 200' is mounted to be detachable therefrom unlike the structure of the exemplary embodiment with reference to FIGS. 1 to 3, 4A and 4B, 5A and 5B, 6A to 6D, and 7A and 7B. Thus, hereinafter, a description of overlapping portions will be omitted and a description of the configuration with regard to a frame 100' and a radiator 200' will mainly be provided.

As illustrated in FIGS. 12 to 14, 15A and 15B, and 16A to 16C, a frame 100' according to the present exemplary embodiment may include a first frame portion 120 having a device region 110 on which a radiator 200' is mounted, and a second frame portion 130 extended to be perpendicular to the first frame portion 120. Furthermore, the frame 100' may have an extended step structure in which the first and second frame portions 120 and 130 are alternately connected to each other. Therefore, the plurality of device regions 110 may be positioned at different levels, that is, disposed at different heights.

The first frame portion 120 may include a mounting surface 121 on which the radiator 200' is mounted, and a side wall 122 forming a space having a predetermined size defining the device region 110 together with the mounting surface 121.

The second frame portion 130 may have a structure in which one end thereof is extended from the side wall 122 and the other end thereof configures a portion of a side wall 122 of a different first frame portion 120 so as to integrally connect the first frame portion 120 to the second frame portion 130.

The fixer 150 may selectively fasten and fix the support member 220 of the radiator 200' such that the radiator 200' is mounted on the device region 110 to be detachable therefrom. In detail, the fixer 150 may be elastically provided with a side contacting the support member 220 of the device region 110, that is, the side wall 122. Plural fixers 150 may be provided for each device region 110, e.g., a pair of fixers 150 may be each provided on mutually opposing sides of the side walls 122.

The fixer 150 may include a protrusion member 151 protruded toward to the device region 110. The protrusion member 151 may have a curved surface inclined from an upper part to a lower part. Thus, in the case in which the radiator 200' is mounted on the mounting surface 121, the support member 220 may slidably move along the curved surface to be mounted on the mounting surface 121.

Figure 16A:
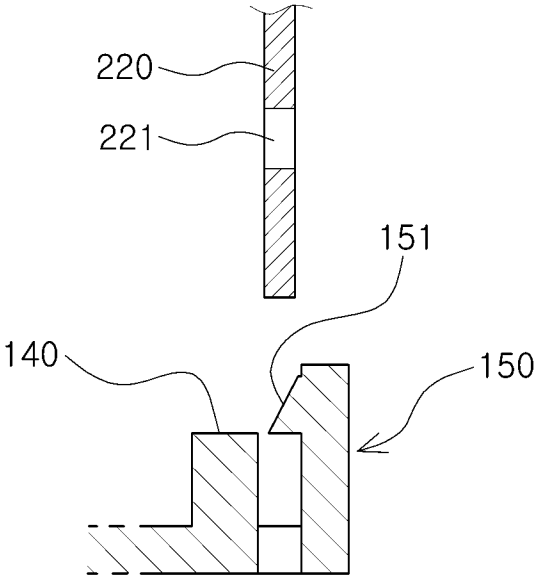
FIGS. 16A to 16C are cross-sectional views schematically showing an operating state of a fixer in the light source assembly of FIG. 12.
Figure 16B:
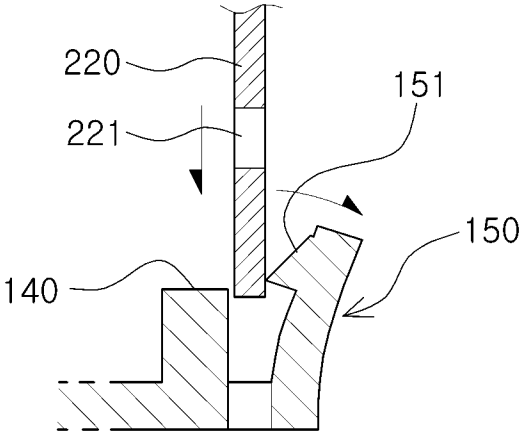
Figure 16C:
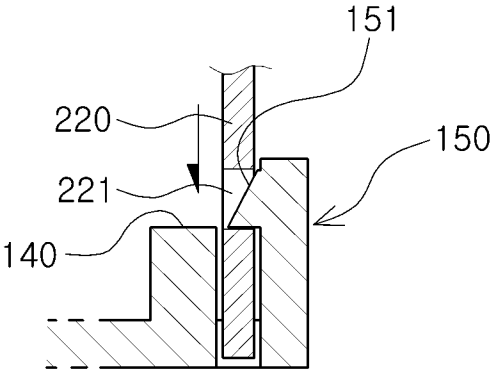

FIG. 15 illustrates the radiator 200' according to the present exemplary embodiment. The support member 220 of the radiator 200' may include fastening holes 221 into which the protrusion members 151 are inserted when the support members 220 are mounted on the device region 110. Therefore, as shown in FIGS. 16A to 16C, the fixer 150 pushed out to the outside of the frame 100' may be restored to an original position by elasticity of the protrusion member 151 when the protrusion member 151 is inserted into the fastening hole 221.

The radiator 200' mounted on the device region 110 may be stably fixed thereto as the protrusion member 151 of the fixer 150 is inserted into the fastening hole 221 of the support member 220 to be caught thereby and fixed thereto. In addition, as the protrusion member 151 is removed from the fastening hole 221, the radiator 200' may be easily detached from the device region 110.

In the radiator 200', the radiating rod 230 may be provided with a lower surface of the base member 210 as shown in FIG. 5.

As such, according to exemplary embodiments, the radiator 200' may be easily mounted on the frame 100' through a relatively simple catching and fixing scheme. In addition, the radiator 200' may be detachable using the fixer 150 having elasticity, which may vary so as to be installed in various models.

Figure 17:
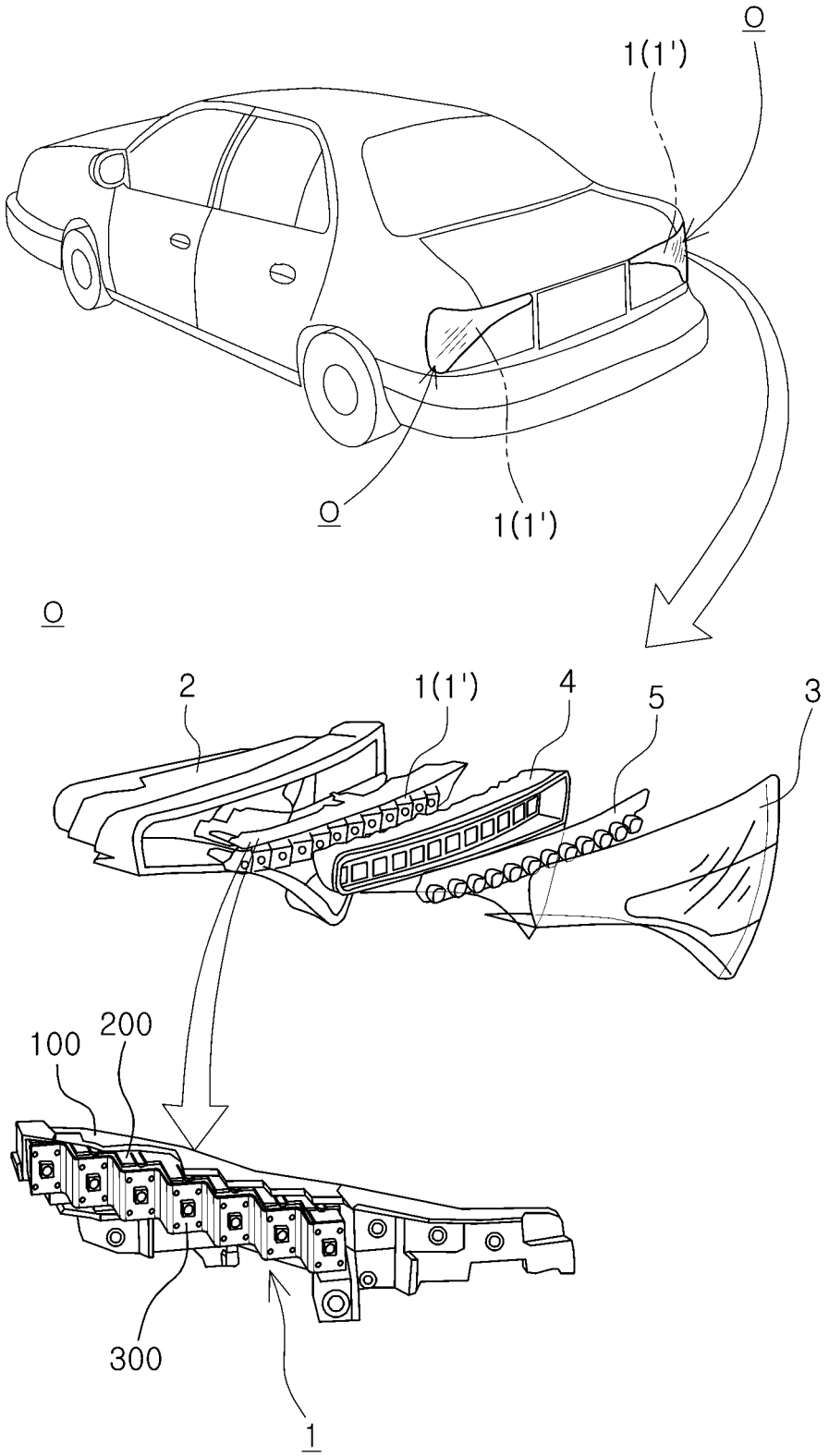
FIG. 17 schematically illustrates an illumination device according to an exemplary embodiment.

FIG. 17 schematically illustrates an illumination device O according to an embodiment of the present invention. The illumination device O may include, for example, an automobile taillight having the light source assembly 1 or 1' therein described above.

As shown in FIG. 17, the illumination device O may include a housing 2 supported by the light source assembly 1 or 1' and a cover 3 covering the housing 2 to protect the light source assembly 1 or 1'. The light source assembly 1 or 1' may include a reflector 4, a lens 5, and the like disposed thereon.

The illumination device O may have a gradually curved surface shape overall, corresponding to an automobile corner portion shape, and thus, the plurality of radiators 200 may be assembled to be suitable for the curved shape of the illumination device O to thereby form the light source assembly 1 or 1' having a step structure.

Although the present exemplary embodiment provides the case in which the frame 100 and the radiators 200 installed therein have an overall linear form according to the design of the illumination device by way of an example, the structure of the light source assembly 1 or 1' described above may be varied, depending upon a design of an illumination device O, e.g., a taillight. In addition, the number of the radiators 200 assembled with one another thereby may be changed variously. Such variations may be easily undertaken through a simple assembly process of the plurality of radiators 200.

Figure 18:
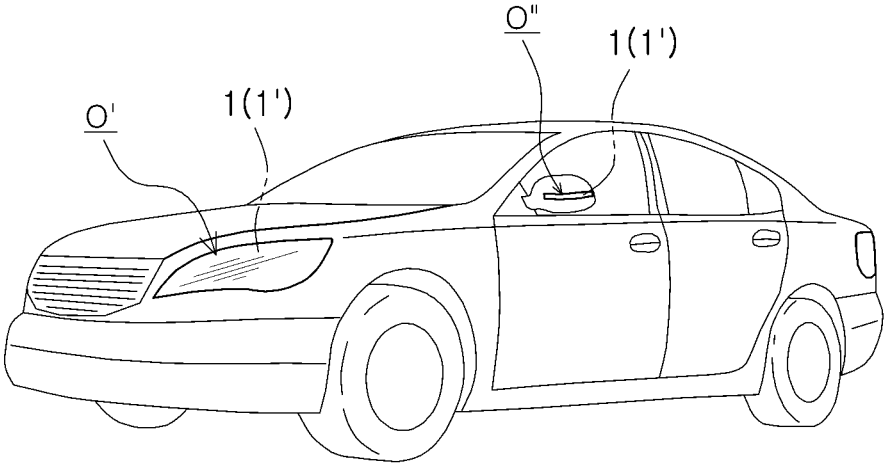
FIG. 18 schematically illustrates the illumination device of FIG. 17 according to another exemplary embodiment.

The present exemplary embodiment provides the case in which the illumination device O is an automobile taillight by way of an example, although it is understood that one or more other exemplary embodiments are not limited thereto. For example, as shown in FIG. 18, an illumination device O' may include an automobile head lamp. In addition, the light source assembly 1 or 1' may easily have a multi-step structure so as to correspond to the curved surface shape of the head lamp through the assembled radiators 300.

Further, the illumination device O" may include an automobile side mirror turn signal. Similarly, the light source assembly 1 or 1' may be easily assembled to have a form corresponding to a curved surface shape of the turn signal.

As set forth above, according to an exemplary embodiment, a light source assembly 1 or 1' capable of being standardly used in automobiles, regardless of the model thereof, by standardizing a heat sink structure and being easily mounted may be provided.

While exemplary embodiments have been shown and described above, it will be apparent to those skilled in the art that modifications and variations can be made without departing from the spirit and scope of the inventive concept as defined by the appended claims.

What is claimed is:

1. A light source assembly comprising:

a frame comprising a plurality of device regions;

a plurality of radiators mounted on the device regions and configured to be detachable therefrom; and a light source comprising a substrate mounted on the plurality of radiators, and a plurality of light emitting devices mounted on the substrate and configured to be disposed in positions corresponding to the device regions above the radiators, respectively, wherein the substrate mounted on the plurality of radiators extends such that the plurality of radiators are connected to one another by the substrate, and wherein the substrate is configured to be disposed above the frame and spaced apart from the frame by the plurality of radiators.

2. The light source assembly of claim 1, wherein:

plurality of device regions are configured to be at different height levels, and wherein the plurality of radiators are mounted on the plurality of device regions, and the plurality of light emitting devices are disposed at positions corresponding to the plurality of device regions above the plurality of radiators.

3. The light source assembly of claim 1, wherein the frame further comprises first frame portions comprising the device regions, and second frame portions extended in a direction perpendicular to the first frame portions, and wherein the first frame portions and the second frame portions are alternately connected to each other in an extended step structure.

4. The light source assembly of claim 3, wherein the first frame portions further comprise mounting surfaces on which the radiators are mounted, and side walls forming spaces defining the device regions together with the mounting surfaces, and wherein the mounting surfaces each comprise a radiation hole provided in a central portion of the mounting surfaces and configured to allow air to flow therethrough.

5. The light source assembly of claim 1, wherein the radiators each comprise:

a base member on which the light emitting device is disposed and supported; and support members extended from two edges of the base member in a direction perpendicular to a direction of the base member, and mounted on the device regions.

6. The light source assembly of claim 5, wherein the radiators each further comprise auxiliary support members extended from two remaining edges of the base member in the direction perpendicular to the direction of the base member.

7. The light source assembly of claim 5, wherein the radiators each further comprise a radiating rod extending from a lower surface of the base member.

8. The light source assembly of claim 5, wherein:

the frame further comprises guide members in each of the device regions; and the support members are insertedly fixed to the device regions by the guide members when the support members are mounted on the device regions.

9. The light source assembly of claim 5, wherein the base member comprises at least one alignment hole configured to guide a disposition of the light emitting device.

10. The light source assembly of claim 3, wherein the substrate is between the plurality of radiators and the plurality of light emitting devices.

11. A light source assembly comprising:

a frame comprising a plurality of device regions;

a plurality of radiators each comprising a base member, and support members bent and extended from two edges of the base member, mounted on each of the device regions and configured to be detachable from the device regions through the support members;

a light source comprising a substrate mounted on the plurality of radiators, and a plurality of light emitting devices mounted on the substrate and configured to be disposed in positions corresponding to the device regions above the base member; and fixers selectively fastened to the support members and configured to allow the support members to be mounted on the device regions so as to be detachable from the device regions, wherein the substrate mounted on the plurality of radiators extends such that the plurality of radiators are connected to one another by the substrate, and wherein the substrate is configured to be disposed above the frame and spaced apart from the frame through the plurality of radiators.

12. The light source assembly of claim 11, wherein the fixers are elastically provided on sides of the frame contacting the support members on the device regions and comprise protrusion members protruded toward the device regions.

13. The light source assembly of claim 12, wherein the support members comprise fastening holes into which the protrusion members are inserted when the support members are mounted on the device regions.

14. The light source assembly of claim 11, wherein:

the frame further comprises first frame portions comprising the device region, and second frame portions extended in a direction perpendicular to the first frame portions; and the first frame portions and the second frame portions are alternately connected to each other in an extended step structure.

15. The light source assembly of claim 14, further comprising:

wherein the plurality of radiators are mounted on the plurality of device regions, and the plurality of light emitting devices are disposed at positions corresponding to the plurality of device regions above the plurality of radiators, and wherein the substrate is between the plurality of radiators and the plurality of light emitting devices.

16. A light source assembly comprising:

a frame comprising a plurality of device regions;

a plurality of radiators detachably mounted on the device regions and each comprising a base member for mounting a light emitting device, the plurality of radiators are configured to discharge heat from the light emitting device into spaces between the device regions and the radiators; and a substrate mounted on the plurality of radiators, wherein the substrate mounted on the plurality of radiators extends such that the plurality of radiators are connected to one another by the substrate, and wherein the substrate is configured to be disposed above the frame and spaced apart from the frame through the plurality of radiators.

17. The light source assembly of claim 16, further comprising:

a plurality of light emitting devices mounted on the substrate;

wherein the plurality of device regions are configured to be at different height levels, and wherein the plurality of radiators are mounted on the plurality of device regions.

18. The light source assembly of claim 16, wherein:

the frame further comprises first frame portions comprising the device regions, and second frame portions extended in a direction perpendicular to the first frame portions; and the first frame portions and the second frame portions are alternately connected to each other in an extended step structure.

19. The light source assembly of claim 18, wherein the first frame portions further comprise mounting surfaces on which the radiators are mounted, and side walls forming the space defining the device regions together with the mounting surfaces, and the mounting surfaces comprise the spaces in central portions of the mounting surfaces which are configured to allow the heat to discharge therethrough.

20. The light source assembly of claim 16, wherein the radiators further comprise support members extended from two edges of the base member in a direction perpendicular to a direction of the base member and mounted on the device regions.

* * * * *